United States Patent [19]

Berry

[11] 3,947,788

[45] Mar. 30, 1976

[54] SOLENOID

[75] Inventor: William R. Berry, Menomonee Falls, Wis.

[73] Assignee: Spencer C. Schantz, New Berlin, Wis.

[22] Filed: Sept. 3, 1974

[21] Appl. No.: 502,579

[52] U.S. Cl. ..... 335/68; 335/70; 68/17 R; 222/70

[51] Int. Cl.[2] ..... H01H 9/00

[58] Field of Search ..... 335/68, 76, 274, 279, 278, 335/251, 260, 261, 262, 255; 222/70; 68/17 R; 318/225 R; 251/141

[56] References Cited

UNITED STATES PATENTS

| | | | |
|---|---|---|---|
| 3,079,944 | 3/1963 | McLaughlin | 68/17 R X |
| 3,207,373 | 9/1965 | Dannenmann | 68/17 R X |
| 3,262,027 | 7/1966 | Zaleske et al. | 335/261 |
| 3,295,079 | 12/1966 | Brown | 335/255 |
| 3,396,354 | 8/1968 | Fisher | 335/262 X |
| 3,593,240 | 7/1971 | Garczynski | 335/261 |
| 3,665,353 | 5/1972 | Campbell | 335/274 X |

*Primary Examiner*—G. Harris
*Attorney, Agent, or Firm*—Arthur L. Morsell, Jr.

[57] ABSTRACT

A solenoid coil is connected in series with an electric motor. The spring which urges the solenoid plunger away from the coil is of such strength that it will yield to the magnetic attraction of the coil when the motor-starting inrush current is flowing through the coil, but will not yield when the motor-running current is flowing through the coil. Thus the solenoid plunger reciprocates each time the motor is started. The solenoid plunger is formed of a flat sheet of magnetic material curled into the shape of a hollow cylindrical shell. The solenoid frame has a forked portion through which the plunger extends, the forked portion having sufficient depth to minimize side loading of the plunger. An end of the frame is also shaped to act as a spring in holding the solenoid parts in assembled relationship.

9 Claims, 8 Drawing Figures

SOLENOID

BACKGROUND OF THE INVENTION

This invention relates to solenoids and more particularly to solenoids that are used in combination with electric motors. In the past, when it was desired to reciprocate the plunger of a solenoid in order to perform mechanical work during starting of a motor, e.g. to dispense detergent in an automatic washer, it has been necessary to provide a relay capable of energizing the solenoid during starting, and also of de-energizing the solenoid to provide a return stroke for the solenoid plunger. In accordance with this invention, however, an improved solenoid arrangement has been devised that will accomplish both plunger movements without a relay circuit. The solenoid of this invention also incorporates other improvements as described hereinafter.

SUMMARY OF THE INVENTION

A solenoid coil is connected in series with an electric motor. There is spring means urging the solenoid plunger away from the coil which is of such strength that it will yield to the magnetic attraction of the coil when the motor-starting inrush current is flowing through the coil but not when the motor-running current is flowing through the coil. In the preferred embodiment, the solenoid plunger is formed of a flat sheet of magnetic material curled into the shape of a hollow cylindrical shell. Also in the preferred embodiment, the solenoid frame has a portion which coacts with the plunger to minimize side loading of the plunger, and the frame has a portion which is shaped to serve as a spring in holding the solenoid parts in assembled relationship.

One object of this invention is to provide an improved solenoid which is so constructed that, when it is coupled in series with an electric motor, the plunger is reciprocated in both an inward and a return direction in response to motor-starting inrush current.

Another object of this invention is to provide, in a solenoid, an improved plunger which is lighter in weight, lower in eddy current loss, and less expensive than the solenoid plungers heretofore known in the art.

A further object of this invention is to provide, in a solenoid, a frame portion which is shaped to act as a spring for holding the parts of the solenoid in assembled relationship.

An additional object of this invention is to provide, in a solenoid, a frame portion having means arranged to minimize side loading on the solenoid plunger.

Other objects, advantages, and features of the invention will be apparent to those skilled in the art from the description which follows.

DESCRIPTION OF THE PREFERRED EMBODIMENT

Figure 1:
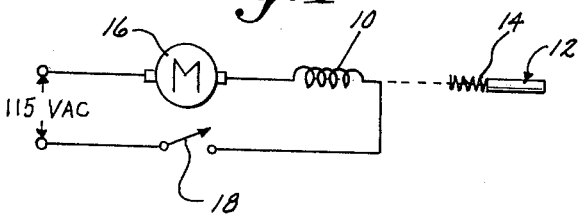
FIG. 1 is a schematic circuit diagram showing one embodiment of the invention connected in series with an electric motor and switch therefor.
Figure 2:
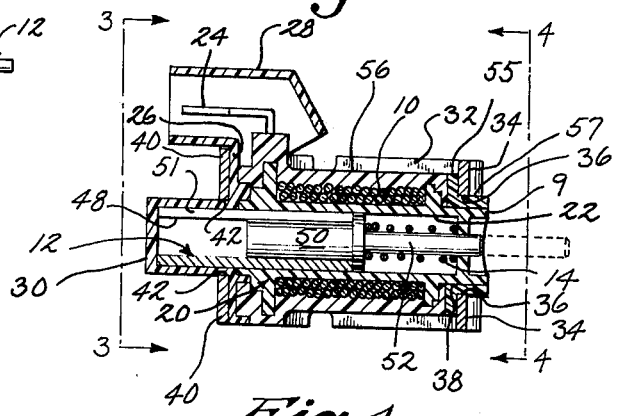
FIG. 2 is a longitudinal sectional view of one embodiment of the invention.
Figure 3:
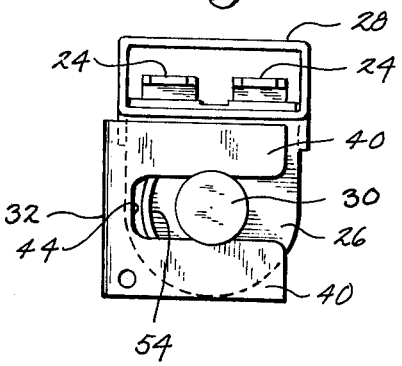
FIG. 3 is a front end view taken as indicated by the line 3—3 of FIG. 2.
Figure 4:
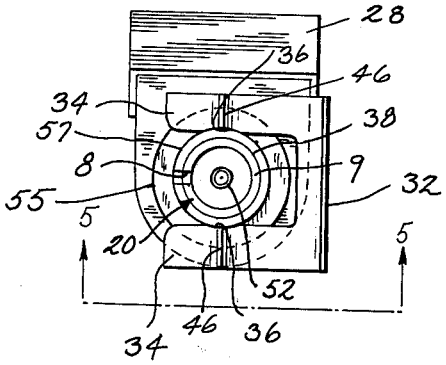
FIG. 4 is a rear end view taken as indicated by the line 4—4 of FIG. 2.

FIG. 1 is a schematic diagram of one embodiment of the invention which comprises a coil 10, a magnetic plunger 12, and a spring 14, the latter normally urging the plunger 12 away from coil 10. Coil 10 is connected in series with an electric motor 16 and with a toggle switch 18. When toggle switch 18 is closed, 115 volts AC current is applied across the series combination of motor 16 and coil 10. This causes an initial starting inrush current through motor 16 and coil 10. After the motor 16 has started, the current through motor 16 and coil 10 drops to the running level for the motor, which may be as low as 20% of the starting inrush level. The spring 14 is selected to be of such strength as to allow plunger 12 to move against spring 14 in response to the magnetic attraction of the starting inrush current through coil 10, but the spring is stronger than the running level current. Thus, during the time interval that the starting inrush current is flowing through motor 16 and coil 10, typically in the order of 0.1 seconds, the magnetic plunger 12 is attracted toward coil 10 and moves theretoward against the force of spring 14, compressing spring 14 as it moves. When the current through motor 16 and coil 10 drops down to the running level, the attraction between coil 10 and magnetic plunger 12 drops below the force of compressed spring 14, which therefore causes plunger 12 to move away from coil 10 back toward its starting position. This produces a reciprocal movement of plunger 12 which may be utilized by conventional mechanical linkages, not shown to perform useful work, e.g. to dispense detergent in an automatic washer. Heretofore, in order to obtain a return movement of the plunger in a similar situation, it has been necessary to provide a special relay arrangement.

Figure 6:
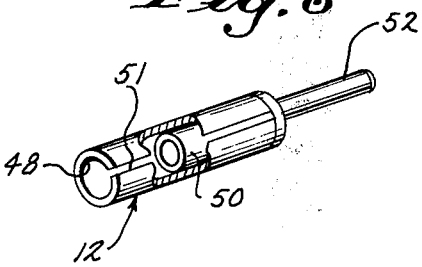
FIG. 6 is a perspective view partially cut away, of the solenoid plunger used in FIG. 2.
Figure 7:
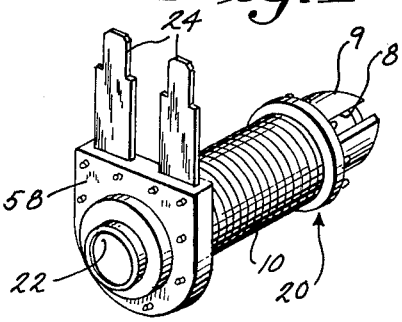
FIG. 7 is a perspective view of the solenoid frame shown in FIGS. 2 through 5.
Figure 8:
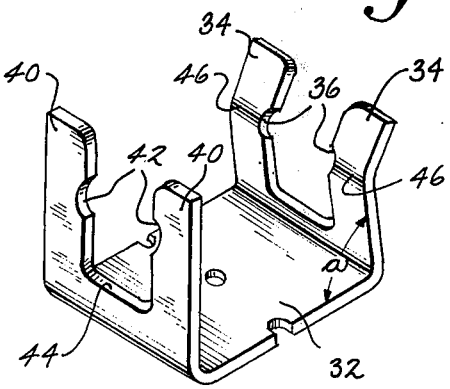

FIGS. 2 through 7 show the preferred physical structure for the solenoid of this invention. The coil 10 is wound upon a bobbin 20 having a cylindrical bore 22 for slideably receiving the plunger 12. The bobbin has a cylindrical projection 9 at one end (see FIGS. 5 and 7) which has an axially-extending slot 8. The slot communicates with the interior bore of the extension and provides for drainage of moisture from the slot. Such moisture might at times be pulled into the bore 22 of the core by the stem 52 during operation, as much moisture is present in a washing machine where this type of solenoid might be used. A pair of electrical terminals 24 are attached to the bobbin 20 and to the ends of coil 10 by conventional means. An end piece 26 which includes an insulating hood 28 for terminals 24 and a hollow cylindrical shell 30 for plunger 12 is held against the left hand end of bobbin 20 (referring to FIG. 2) by a U-shaped frame 32 (FIG. 8). The frame 32 is made out of spring steel and is shaped to embrace the ends of bobbin 20 and end piece 26 to hold the two pieces together. For this purpose, the frame 32 has a forked end to provide two rear legs 34 which are notched at 36 to engage around the cylindrical end 38 (FIG. 4) of bobbin 20. The opposite end of frame 32 is also forked to provide two front legs 40 which are notched at 42 to engage the cylindrical end 30 (FIG. 3) of end piece 26. The forked end provides a deep recess whose bottom 44 is sufficiently spaced from the plunger end as to minimize side loading on the plunger 12 as described hereinafter.

Figure 5:
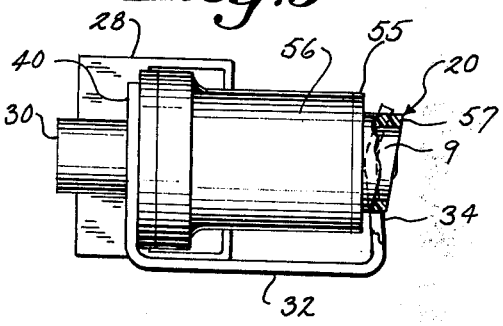
FIG. 5 is a bottom view taken as indicated by the line 5—5 of FIG. 4.

The rear legs 34 are at an acute angle (a) with respect to the base and are bent into a shallow V-shape, the apex 46 of which is aligned with the notches 36 so as to apply spring force to the cylindrical end 38 (FIG. 4) of bobbin 20. Due to the angle (a) and to the V-bends, and as best shown in FIG. 5, the spring force of frame 32 is applied only along the apex 46 of the bend in the rear legs 34.

The magnetic plunger 12 is preferably formed of a flat sheet of iron or steel which is curled up as shown in FIG. 6 to form a hollow cylinder 48. The opposite ends 51 of the rolled-up sheet 48 are preferably adjacent each other as shown. In this particular embodiment, hollow cylinder 48 is fitted around a molded plastic core 50 having a stem 52 which projects from the end of bobbin 20 as indicated by the dashed lines in FIG. 2 when magnetic plunger 12 is moved outwardly. The spring 14 (FIG. 2) normally urges the plunger 12 against the end of cylinder 30. In addition to acting as a mechanical linkage for plunger 12, stem 52 also acts as a support for spring 14. The use of a curled-up sheet of iron or steel for the plunger 12 reduces its cost in comparison to a solid steel plunger and also reduces its weight and its eddy current losses.

As described above, the spring 14 is of such strength that it will yield to the electromagnetic attraction of coil 10 when the starting inrush current of motor 16 is flowing through coil 10 but will not yield when the normal running current of motor 16 is flowing through coil 10. Therefore, when the motor 16 is started, plunger 12 is moved to the right in FIG. 2, causing stem 52 to be extended beyond the end of bobbin 20 as indicated by the dashed lines in FIG. 2. This movement of stem 52 can be used to transmit movement to a mechanical linkage or other means of performing useful work, e.g. to dispense detergent in an automatic washer.

One of the problems in the prior art solenoid constructions is that the U-shaped opening of the frame of the solenoid, through which the plunger extends, causes unequal magnetic forces to act laterally on the plunger to thus place a side load thereon and cause the plunger to scrape against the side of the hollow cylinder within which the plunger moves. These unequal forces are due to the fact that the frame portion at the bottom of the U-shaped opening is close to the plunger to exert a magnetic force thereon whereas there is no opposite frame portion at the opposite side of the U-shaped opening. To minimize such side loading, a deep recess with a bottom 44 (FIGS. 3 and 7), which is spaced a substantial distance from the plunger and cylinder 30, is used. A tongue 54 (FIG. 3) is formed on the end of the end piece 26 and projects through the recess 44 to extend transversely therein so as to prevent frame 32 from rotating relative to the cylinder 30.

It is preferred to employ an extra washer 55 at the end of the device between the legs 34 and the end of the bobbin covering 56. The washer has a cylindrical extension 57 which is shaped to surround the cylindrical projection 9 of the bobbin. The washer extension 57 will have an axial slot registering with the slot 8 of the bobbin extension through which moisture may drain. Both the bobbin extension 9 and the washer extension 57 are preferably cut off at an oblique angle as shown in FIGS. 5 and 7. The bobbin covering is formed by a molded coating of suitable plastic material which covers the wound bobbin of FIG. 7 and the end piece 58 of the bobbin. The extra washer 55 provides additional electrical insulation as a safeguard.

Various changes and modifications may be made without departing from the spirit of the invention, and all of such changes are contemplated as may come within the scope of the claims.

What I claim is:

1. In an electric circuit having an electric motor and having a starting switch for said motor, a solenoid having a coil and having a plunger mounted for movement in one direction as a result of magnetic attraction when the coil is energized, and there being spring means associated with the plunger to normally urge the latter in a return direction, the improvement comprising having the solenoid coil in series in the electric circuit with said motor and starting switch, and having said spring means of less strength than the strength of the magnetic attraction between the coil and plunger when motor-starting inrush current is flowing through said coil but being of greater strength than the strength of said magnetic attraction when motor-running current is flowing through the coil to automatically cause quick return movement of the plunger while the coil is still energized, whereby quick movement of the plunger in both directions is initiated whenever the motor is started.

2. In a solenoid having a coil, a magnetic plunger mounted for movement in one direction as a result of magnetic attraction when the solenoid is energized, and spring means associated with said coil to normally urge said plunger in a return direction, said spring means being of less strength than the magnetic attraction between the coil and plunger when the current flowing through said coil on initial energization is above a predetermined level, but being of greater strength than the magnetic attraction when current thereafter drops below said predetermined level to cause return movement of the plunger while the coil is still energized, whereby there is automatic movement of the plunger in both directions following initial energization of the coil.

3. The solenoid of claim 2 and further comprising a magnetic frame for said solenoid having a forked end embracing one end of said plunger, said forked end encluding a U-shaped opening with an open end and a closed end, said closed end being spaced sufficiently from the sides of said plunger as to minimize side loading due to unequal magnetic forces acting laterally on the plunger.

4. Apparatus as claimed in claim 3 wherein the legs of one of said spaced ends of the frame are transversely kinked along a transverse line, with said transverse line yieldingly bearing against the end of the coil housing and constituting the only contact between said frame end and said coil housing.

5. Apparatus as claimed in claim 4 in which said coil housing is circular in cross section, and in which said transverse line of kink bears against the end of the coil housing along a diameter thereof.

6. Apparatus as claimed in claim 4 wherein the legs which are transversely kinked are bent from the base of the U-shaped frame, with the portions of said legs which are near the line of bend at an acute angle with respect to the base of the U-shaped frame.

7. In a solenoid having a coil, a magnetic plunger mounted for movement within said coil so that a portion is movable into and out of an end thereof, a magnetic frame for said solenoid having forked ends with each forked end including spaced legs, one end of said plunger projecting through one of said forked ends, said last-mentioned forked end including a U-shaped opening with an open end and a closed end, said closed end being spaced sufficiently from the sides of said plunger as to minimize side loading due to unequal magnetic forces acting laterally on the plunger, the coil being wound on a bobbin, and said bobbin having a cylindrical extension at one end, in which the spaced legs at one end of the frame embrace said cylindrical extension, and in which there is an electrical insulating washer surrounding the cylindrical extension of the bobbin and located between the spaced legs and the end of the coil housing, said washer having a cylindrical extension surrounding the cylindrical extension of the bobbin and also embraced by the spaced legs of the frame.

8. In a solenoid having a coil, a magnetic plunger mounted for movement within said coil so that a portion is movable into and out of an end thereof, a magnetic frame for said solenoid having forked ends with each forked end including spaced legs, one end of said plunger projecting through one of said forked ends, said last-mentioned forked end including a U-shaped opening with an open end and a closed end, said closed end being spaced sufficiently from the sides of said plunger as to minimize side loading due to unequal magnetic forces acting laterally on the plunger, the coil being wound on a bobbin having end portions and there being an end piece having a cylindrical extension aligned with and of a size to accommodate said plunger, and in which the spaced legs at one end of the frame embrace said cylindrical extension to maintain said end piece in assembled relationship against one end of the bobbin, said cylindrical extension having a closed outer end forming a stop to limit the return stroke of the plunger.

9. Apparatus as claimed in claim 7 in which there is an electrically insulating end piece having a cylindrical extension positioned adjacent the end of the bobbin which is opposite the end of the bobbin having said washer, and in which spaced legs at the adjacent end of the frame maintain said end piece in assembled relationship with the cylindrical extension aligned with and of a size to accommodate the plunger, said cylindrical extension having a closed outer end forming a stop to limit the return stroke of the plunger.

* * * * *